US005256998A

United States Patent [19]

Becker et al.

[11] Patent Number: 5,256,998

[45] Date of Patent: Oct. 26, 1993

[54] ACTUATOR

[75] Inventors: Klaus Becker; Rüdiger Ostholt, botn of Wetter; Nikolaus Petershagen, Dortmund, all of Fed. Rep. of Germany

[73] Assignee: Technische Entwicklungen Dr. Becker GmbH, Wetter

[21] Appl. No.: 966,803

[22] Filed: Oct. 26, 1992

[30] Foreign Application Priority Data

Oct. 25, 1991 [DE] Fed. Rep. of Germany ... 9113469[U]

[51] Int. Cl.[5] ..... H01F 7/16; H01F 7/13

[52] U.S. Cl. ..... 335/229

[58] Field of Search ..... 335/229-235, 335/243, 1, 251, 263, 179

*Primary Examiner*—Leo P. Picard
*Assistant Examiner*—Raymond Barrera
*Attorney, Agent, or Firm*—Cohen, Pontani, Lieberman, Pavane

[57] ABSTRACT

An actuator includes a housing and a stationary, annular magnet coil to which a reversible direct current can be supplied. A displacement member which partially surrounds the magnet coil is mounted within the housing so as to be linearly moveable. A first pair of permanent magnets is mounted in the displacement member so as to cover a portion of the coil, wherein the north pole is located above the coil and the south pole is located below the coil. A second pair of permanent magnets is also mounted in the displacement member so as to cover a portion of the magnet coil. The second pair of permanent magnets is arranged diametrically opposite the first pair relative to the magnet coil and the south pole of the second pair is arranged above the magnet coil and the north pole below the magnet coil. Thus, when the magnet coil is excited, the displacement member linearly moves within the housing relative to the stationary coil. At least one connecting piece is attached to the displacement member so as to extend out of the housing.

6 Claims, 1 Drawing Sheet

ACTUATOR

BACKGROUND OF THE INVENTION

The present invention relates to an actuator to be used for various different purposes in which a displacement with a linear movement is required, for example, for sorter switch points in conveyor systems. An actuator of this type can also be used for applying a force in a linear direction.

SUMMARY OF THE INVENTION

It is an object of the present invention to provide an actuator of the above-described type which is capable of developing a displacement force which is the same in both directions of movement and which, moreover, is virtually constant over the entire displacement path.

It is another object of the present invention to provide an actuator which is composed of few parts and is preferably subject to virtually no wear, so that inspection and replacement of parts within short time intervals are not necessary.

In accordance with the present invention, the actuator includes a housing and a stationary, annular magnet coil to which a reversible direct current can be supplied. A displacement member which partially extends over the magnet coil is linearly movably mounted within the housing. The displacement member includes a first pair of permanent magnets arranged in such a way that the north pole is located above the magnet coil and the south pole is located below the magnet coil and the first pair of permanent magnets covers a portion of the magnet coil. A second pair of permanent magnets is arranged in the displacement member spaced apart from the first pair of permanent magnets and mounted so as to extend over a portion of the magnet coil which is located diametrically opposite the first pair of permanent magnets. Of the second pair of permanent magnets, the south pole is arranged above the magnet coil and the north pole is arranged below the magnet coil. When the magnet coil is excited, the displacement member is moved linearly within the housing relative to the stationary magnet coil. A connecting piece which extends out of the housing is arranged at least on one side of the displacement member.

In accordance with a preferred feature of the present invention, the housing of the actuator includes an upper part and a lower part which are essentially of identical construction.

In accordance with another feature, the connecting piece has an angular cross-section and the opening through which the connecting piece extends out of the housing has a shape which is adapted to the cross-section of the connecting piece.

Another feature of the present invention provides guide means for the displacement member mounted within the housing in order to prevent rotation of the displacement member relative to the housing.

Damping means can be provided at the ends of the housing for limiting the linear movement of the displacement member within the housing.

Thus, the only moveable part in the actuator according to the present invention is the displacement member whose linear movement is effected by utilizing the physical principle of the Lorentz force. This linear movement is transmitted to the outside through the connecting piece. This connecting piece may then be connected in a suitable manner to a machine element to be moved.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF THE PREFERRED EMBODIMENT

Figure 1:
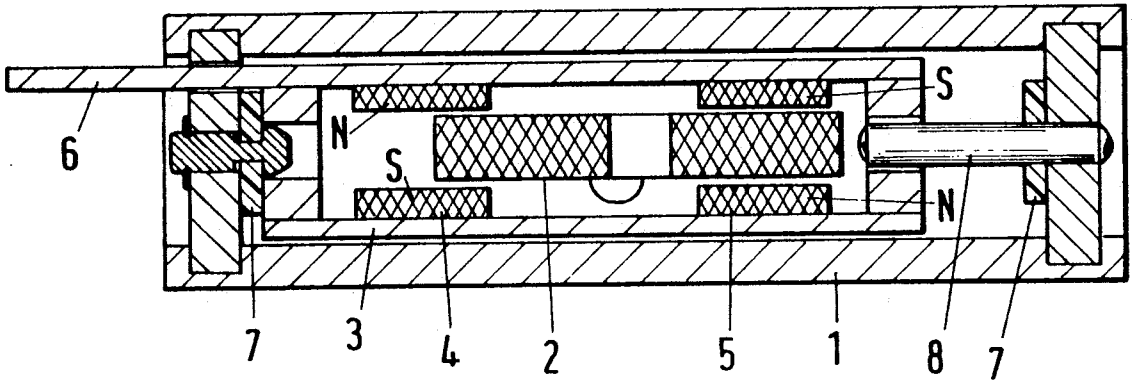
FIG. 1 is a schematic sectional view of the actuator according to the present invention.
Figure 2:
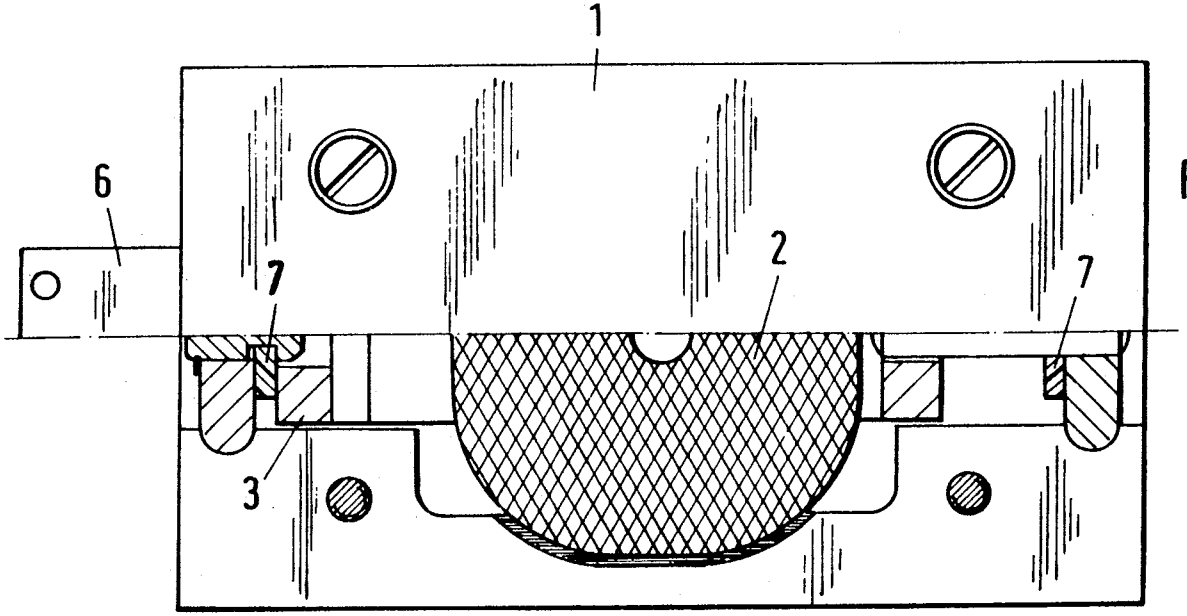
FIG. 2 is a top view, partially in section, of the actuator of FIG. 1.

As illustrated in FIGS. 1 and 2 of the drawing, the actuator includes a housing 1 and a stationary, annular magnet coil 2 mounted within the housing 1. The housing 1 is divided in the area of the center plane of the magnet coil 2 and, thus, has an upper part and a lower part, wherein the two parts are essentially of identical construction.

A displacement member 3 is linearly movably mounted in the housing 1. This linear movement can be obtained by suitable guides in the housing. Such a guide may be, for example, a centrally arranged bolt 8 or the connecting piece 6 which is connected to the displacement member 3. The connecting piece 6 extends out of the housing through the front side of the housing. It is an advantage if the connecting piece has an angular cross-section, for example, a rectangular cross-section and the opening in the housing for the connecting piece has the same shape. This not only ensures a linear movement but also prevents rotation of the displacement member 3 in the housing 1.

The displacement member 3 has pairs of permanent magnets 4 and 5 which face the magnet coil 2. As illustrated in FIG. 1, the magnets of each pair of permanent magnets are axially spaced from each other. In addition, the pairs of permanent magnets are arranged in such a way that one pair covers a portion of the magnet coil 2 while the other pair covers a portion of the magnet coil 2 diametrically opposite the first pair. Also, the first pair of permanent magnets 4 has the north pole above the magnet coil 2 and the south pole below the magnet coil 2 while the pair of permanent magnets 5 has the south pole above the magnet coil 2 and the north pole below the magnet coil 2.

Accordingly, when a direct current is applied to the magnet coil 2, the above-mentioned physical principle of the Lorentz force causes as a result of the pattern of field lines of the permanent magnets, a force perpendicularly to the current flow in the magnet coil 2. This force causes a linear displacement of the displacement member 3. As seen in FIG. 1, this means that the displacement member 3 is moved toward the right or toward the left depending on the current flow direction in the coil. When the current flow is appropriately reversed, cycle frequencies of up to 25 hertz are possible by means of this actuator. Since the actuator has only one moveable part, its susceptibility to trouble and wear are significantly reduced.

In order to obtain a displacement which is the same in both directions and which is constant, it is important that the coverage of the windings of the coil with the induction lines of the magnets are the same. This is achieved by appropriately arranging, constructing and adapting the sizes of the coil and magnets.

It should be understood that the preferred embodiments and examples described are for illustrative purposes only and are not to be construed as limiting the scope of the present invention which is properly delineated only in the appended claims.

What is claimed is:

1. An actuator comprising a housing and a stationary, annular magnet coil mounted in the housing, means for supplying reversible direct current to the magnet coil, a displacement member linearly moveable within the housing, the displacement member extending so as to partially surround the magnet coil, first and second pairs of permanent magnets mounted in the displacement member, the pairs of permanent magnets being mounted so as to partially overlap the magnet coil and being arranged diametrically opposite to each other relative to the magnet coil, the magnet coil having a top and a bottom, wherein a north pole of the first pair of permanent magnets is located above the top of the magnet coil and a south pole of the first pair of permanent magnets is located below the bottom of the magnet coil, and wherein a south pole of the second pair of permanent magnets is located above the top of the magnet coil and a north pole of the second pair of permanent magnets is located below the bottom of the magnet coil, whereby when a current is applied to the magnet coil the displacement member is linearly displaced within the housing relative to the stationary magnet coil, and further comprising at least one connecting piece attached to the displacement member and extending out of the housing through an opening defined in the housing.

2. The actuator according to claim 1, wherein the connecting piece has an angular cross-section and the opening in the housing is adapted to the annular cross-section of the connecting piece.

3. The actuator according to claim 2, wherein the connecting piece has a rectangular cross-section.

4. The actuator according to claim 1, wherein the housing comprises an upper part and a lower part of essentially identical constructions, the coil having a center plane, the upper part and the lower part of the housing being joined together in the center plane of the coil.

5. The actuator according to claim 1, comprising guide means for the displacement member for preventing rotation of the displacement member in the interior of the housing relative to the housing.

6. The actuator according to claim 1, comprising damping means at ends of the housing for limiting the linear movement of the displacement member.

* * * * *